US009007411B2

(12) United States Patent
Cummins et al.

(10) Patent No.: US 9,007,411 B2
(45) Date of Patent: Apr. 14, 2015

(54) REVERSE TRANSFER COLOR PRINTERS FOR HISTOLOGICAL SPECIMEN SLIDES AND CASSETTES

(71) Applicant: Primera Technology, Inc., Minneapolis, MN (US)

(72) Inventors: Robert P. Cummins, Deephaven, MN (US); Darren W. Haas, Minnetonka, MN (US)

(73) Assignee: Primera Technology, Inc., Minneapolis, MN (US)

( * ) Notice: Subject to any disclaimer, the term of this patent is extended or adjusted under 35 U.S.C. 154(b) by 0 days.

(21) Appl. No.: 14/030,371

(22) Filed: Sep. 18, 2013

(65) Prior Publication Data

US 2014/0078235 A1 Mar. 20, 2014

Related U.S. Application Data

(60) Provisional application No. 61/703,120, filed on Sep. 19, 2012.

(51) Int. Cl.
*B41J 2/325* (2006.01)
*B41J 2/005* (2006.01)

(52) U.S. Cl.
CPC ..... *B41J 2/0057* (2013.01)

(58) Field of Classification Search
USPC ..... 347/171, 172, 174, 176, 213; 400/120.01, 120.02, 120.04
See application file for complete search history.

(56) References Cited

U.S. PATENT DOCUMENTS

| | | | | |
|---|---|---|---|---|
| 2,707,066 | A | 4/1955 | Stegeman | |
| 4,171,131 | A | 10/1979 | Stange et al. | |
| 4,220,252 | A | 9/1980 | Beall et al. | |
| 4,705,414 | A | 11/1987 | Guy et al. | |
| 4,823,535 | A | 4/1989 | Schmidt et al. | |
| 5,167,407 | A | 12/1992 | Namba | |
| 5,267,800 | A | 12/1993 | Petteruti et al. | |
| 5,365,312 | A | 11/1994 | Hillmann et al. | |
| 5,372,439 | A | 12/1994 | Poole et al. | |
| 5,423,619 | A | 6/1995 | Kohno | |
| 5,532,724 | A * | 7/1996 | Inagaki et al. | 347/213 |
| 5,534,808 | A * | 7/1996 | Takaki et al. | 327/261 |
| 5,538,688 | A | 7/1996 | Tezuka et al. | |

(Continued)

FOREIGN PATENT DOCUMENTS

| | | | |
|---|---|---|---|
| DE | 3713077 | A1 | 10/1987 |
| JP | 58162442 | A | 9/1983 |

(Continued)

OTHER PUBLICATIONS

International Search Report and Written Opinion issued in PCT/US2011/049221, mailed Mar. 19, 2012, 9 pages.

(Continued)

*Primary Examiner* — Huan Tran
(74) *Attorney, Agent, or Firm* — Faegre Baker Daniels

(57) ABSTRACT

A reverse transfer printer and method for printing information onto histological specimen containers such as slides and cassettes. One embodiment of the method includes printing an ink specimen information image onto a transfer medium, and transferring the transfer medium with the specimen information image onto a print zone of the specimen container, with the transfer medium covering the ink.

7 Claims, 2 Drawing Sheets

(56) References Cited

U.S. PATENT DOCUMENTS

| | | | | |
|---|---|---|---|---|
| 5,562,402 | A | 10/1996 | Muto | |
| 5,676,910 | A | 10/1997 | Levine et al. | |
| 5,683,786 | A | 11/1997 | Kavanaugh | |
| 5,940,111 | A * | 8/1999 | Akada et al. | 347/213 |
| 5,948,685 | A | 9/1999 | Angros | |
| 5,963,368 | A | 10/1999 | Domanik et al. | |
| 6,164,757 | A | 12/2000 | Wen et al. | |
| 6,228,805 | B1 | 5/2001 | Ohshima et al. | |
| 6,261,012 | B1 * | 7/2001 | Haas et al. | 400/208 |
| 6,377,291 | B2 * | 4/2002 | Andoh et al. | 347/213 |
| 6,615,763 | B2 | 9/2003 | Edwards | |
| 6,629,792 | B1 | 10/2003 | Geddes et al. | |
| 6,714,227 | B2 * | 3/2004 | Honma et al. | 347/213 |
| 6,715,870 | B2 | 4/2004 | Kiene et al. | |
| 6,899,030 | B2 | 5/2005 | Fowlkes et al. | |
| 6,951,663 | B1 | 10/2005 | Edwards | |
| 7,124,681 | B2 | 10/2006 | Louviere et al. | |
| 7,271,008 | B2 | 9/2007 | Floyd | |
| 7,449,147 | B2 | 11/2008 | Metzner et al. | |
| 7,579,190 | B2 | 8/2009 | Ostgaard et al. | |
| 7,637,713 | B1 | 12/2009 | Parette | |
| 7,833,485 | B2 | 11/2010 | Higuchi et al. | |
| 8,013,884 | B2 * | 9/2011 | Schlinkmann et al. | 347/171 |
| 2001/0039896 | A1 | 11/2001 | Edwards | |
| 2002/0167577 | A1 | 11/2002 | Kiene et al. | |
| 2003/0025781 | A1 * | 2/2003 | Honma et al. | 347/213 |
| 2003/0049178 | A1 | 3/2003 | Kiene et al. | |
| 2003/0059281 | A1 | 3/2003 | Kiene et al. | |
| 2004/0166030 | A1 | 8/2004 | Lafond et al. | |
| 2005/0094263 | A1 | 5/2005 | Vaccarelli | |
| 2005/0219344 | A1 | 10/2005 | Bouchard et al. | |
| 2006/0051241 | A1 | 3/2006 | Higuchi et al. | |
| 2006/0113315 | A1 | 6/2006 | Chen | |
| 2007/0140920 | A1 | 6/2007 | McCormick | |
| 2007/0141711 | A1 | 6/2007 | Stephens et al. | |
| 2007/0240587 | A1 | 10/2007 | Fengler | |
| 2008/0138854 | A1 | 6/2008 | Williamson | |
| 2009/0223390 | A1 * | 9/2009 | Schlinkmann et al. | 101/35 |
| 2010/0005088 | A1 | 1/2010 | Zhang | |
| 2010/0075410 | A1 | 3/2010 | Desai et al. | |
| 2010/0184127 | A1 | 7/2010 | Williamson, IV et al. | |
| 2010/0220162 | A1 | 9/2010 | Schierholz et al. | |
| 2013/0220156 | A1 * | 8/2013 | Haas et al. | 101/477 |
| 2013/0222444 | A1 * | 8/2013 | Cummins et al. | 347/4 |
| 2013/0224088 | A1 * | 8/2013 | Britz | 422/554 |
| 2014/0212256 | A1 | 7/2014 | Haas | |
| 2014/0225947 | A1 | 8/2014 | Cummins et al. | |

FOREIGN PATENT DOCUMENTS

| | | | | |
|---|---|---|---|---|
| JP | 60055264 | A | 3/1985 | |
| JP | 62030962 | A | 2/1987 | |
| JP | 2003312063 | A | 11/2003 | |
| KR | 100397256 | B1 | 10/1996 | |
| WO | WO2009114471 | A1 | 9/2009 | |
| WO | WO2010032045 | A1 | 3/2010 | |
| WO | WO2012004596 | A9 | 1/2012 | |
| WO | WO 2012/036865 | * | 3/2012 | B41J 2/21 |
| WO | WO 2012/036867 | * | 3/2012 | G01N 35/00 |
| WO | WO 2012/036874 | * | 3/2012 | G01N 35/00 |
| WO | WO2012036865 | A2 | 3/2012 | |
| WO | WO 2012036866 | * | 3/2012 | B41J 2/175 |
| WO | WO2012036866 | A2 | 3/2012 | |
| WO | WO2012036867 | A2 | 3/2012 | |
| WO | WO2012036874 | A2 | 3/2012 | |

OTHER PUBLICATIONS

PPM-21 Maintenance Manual, Takefuji Chemical Co., Ltd., Apr. 10, 2002, 63 pgs. (Japanese document and English translation).

PPM-21 Operation Manual, First Edition: Oct. 14, 2003, Second Edition: Feb. 9, 2005, 55 pgs. (Japanese document and English translation).

PPM-21 Specifications, No. 209A203A, Jul. 3, 2002, 25 pgs. (Japanese document and English translation).

"Sakura Super Frost Printer SSP-600", Sakura Seiki, Jan. 3, 1989, 7 pp.

"Tissue-Tek® AutoWrite Printers—Slide and Cassette Printers", Sakura Finetek USA, Inc., 2003, 4 pp.

[JP document and English translation]Sakura Super Frost II [online], [retrieved 2004] Retrievd from Internet Archive Wayback Machine searching Matsunami Glass website using Internet <URL:http:/ www.web.archive.org/web/20040414050043/http://www. matsunami-glass.co.jp/e-index.html>.

Color ID Card Printer Operating Instructions, Copyright 1997, 78 pp.

Color ID Card Printer Technical Service and Maintenance Manual, Copyright 1994, 52 pp.

International Preliminary Report on Patentability, Chapter II, issued in PCT/US2011/049214, mailed Jan. 3, 2013, 4 pages.

International Preliminary Report on Patentability, Chapter II, issued in PCT/US2011/049221, mailed Dec. 17, 2012, 5 pages.

International Search Report and Written Opinion issued in PCT/US2011/049214, mailed Apr. 10, 2012, 8 pages.

International Search Report and Written Opinion issued in PCT/US2011/049218, mailed Apr. 23, 2012, 9 pages.

International Search Report and Written Opinion issued in PCT/US2011/049380, mailed Mar. 26, 2012, 11 pages.

Internet Archive Wayback Machine, TBS—Triangle Biomedical Sciences, Retrieved from the Internet at http://web.archive.org/web/20021206191110/http:/trianglebiomedical.com/prodShurMark on Feb. 3, 2014. 2 pgs.

Shandon Microwriter™ Labeler Series, Complete laboratory labeling solutions, Thermo Electron Corporation, Sep. 2003., 8 pgs.

Shandon Microwriter™ Labeler Series, Thermo Electron Corporation, Aug. 2005, 20 pgs.

SHUR/Mark® Plus, Innovative Slide and Cassette Labeling Instrumentation/Software Operations and Service Manual, Version 5.0, TBS—Triangle Biomedical Sciences, Inc., Jan. 2001, 104 pgs.

SHUR/Mark® Plus, Innovative Slide and Cassette Labeling Technology, TBS—Triangle Biomedical Sciences, Inc., Apr. 2004, 2 pgs.

Supplementary European Search Report issued in EP Application No. 11825648, completed Feb. 21, 2014, 8 pages.

Tissue-Tek® Autowrite™ Slide Printer Operating Manual, Sakura Finetek USA, Inc., Aug. 12, 2003, 66 pgs.

Tissue-Tek® Autowrite™ Software Instructions, Sakura Finetek USA, Inc., 2007, 40 pgs.

* cited by examiner

REVERSE TRANSFER COLOR PRINTERS FOR HISTOLOGICAL SPECIMEN SLIDES AND CASSETTES

CROSS REFERENCE TO RELATED APPLICATION

This application claims the benefit of U.S. Provisional Application Ser. No. 61/703,120 filed on Sep. 19, 2012, and entitled Reverse Transfer Color Printers For Histological Specimen Slides And Cassettes, which is incorporated herein by reference for all purposes.

TECHNICAL FIELD

The present invention relates to color printers and printing methods for histological specimen containers such as slides and cassettes.

BACKGROUND

Printers for printing information such as text, indentifying color bars and bar codes on containers such as slides and cassettes used to process histological specimens (e.g., tissue biopsies) are generally known and commercially available. Color printers of these types, as well as slides and cassettes that can be used with the printers, are disclosed, for example, in PCT International Application Publication Nos. WO 2012/036865, WO 2012/036866, WO 2012/036867 and WO 2012/036874, all of which are incorporated herein by reference for all purposes.

There remains a continuing need for improved printers for histological sample containers. In particular, there is a need for printers and methods that are efficient to operate, and that enable information to be accurately printed on the containers.

SUMMARY

Embodiments of the invention include a reverse transfer printer and method for printing information onto histological specimen containers such as slides and cassettes. One embodiment of the printer includes (1) a specimen container receiving structure to receive the histological specimen containers, (2) an ink receiving structure to receive an ink source such as a print ribbon, (3) a transfer receiving structure to receive a transfer medium such as a transparent transfer film, (4) a printing area including a printhead, (5) a laminator, and (6) a control system responsive to specimen data representative of histological specimens. The control system causes the printhead to transfer ink from the ink source to print areas on the transfer medium, and to cause the laminator to transfer the printed print areas of the transfer medium to print zones of the specimen containers, with the transfer medium covering the ink on the containers.

DETAILED DESCRIPTION

Embodiments of the invention described herein are color and monochrome printers using reverse transfer-type printing technologies to provide printed specimen information on histological specimen containers such as slides and cassettes. Printers in accordance with the invention can be used to print specimen information onto slides and cassettes of the type described in the above-identified PCT publications. The specimen information printed by the printers of the invention can include text, identifying color bars, bar codes and other information of the types described in the above-identified PCT publications. Reverse transfer printing technologies of the type described generally in the Ohshima U.S. Pat. No. 6,228,805 and the Haas U.S. Pat. No. 6,261,012 can be incorporated into the printers described herein. The Ohshima and Haas patents are hereby incorporated herein by reference for all purposes.

Figure 1:
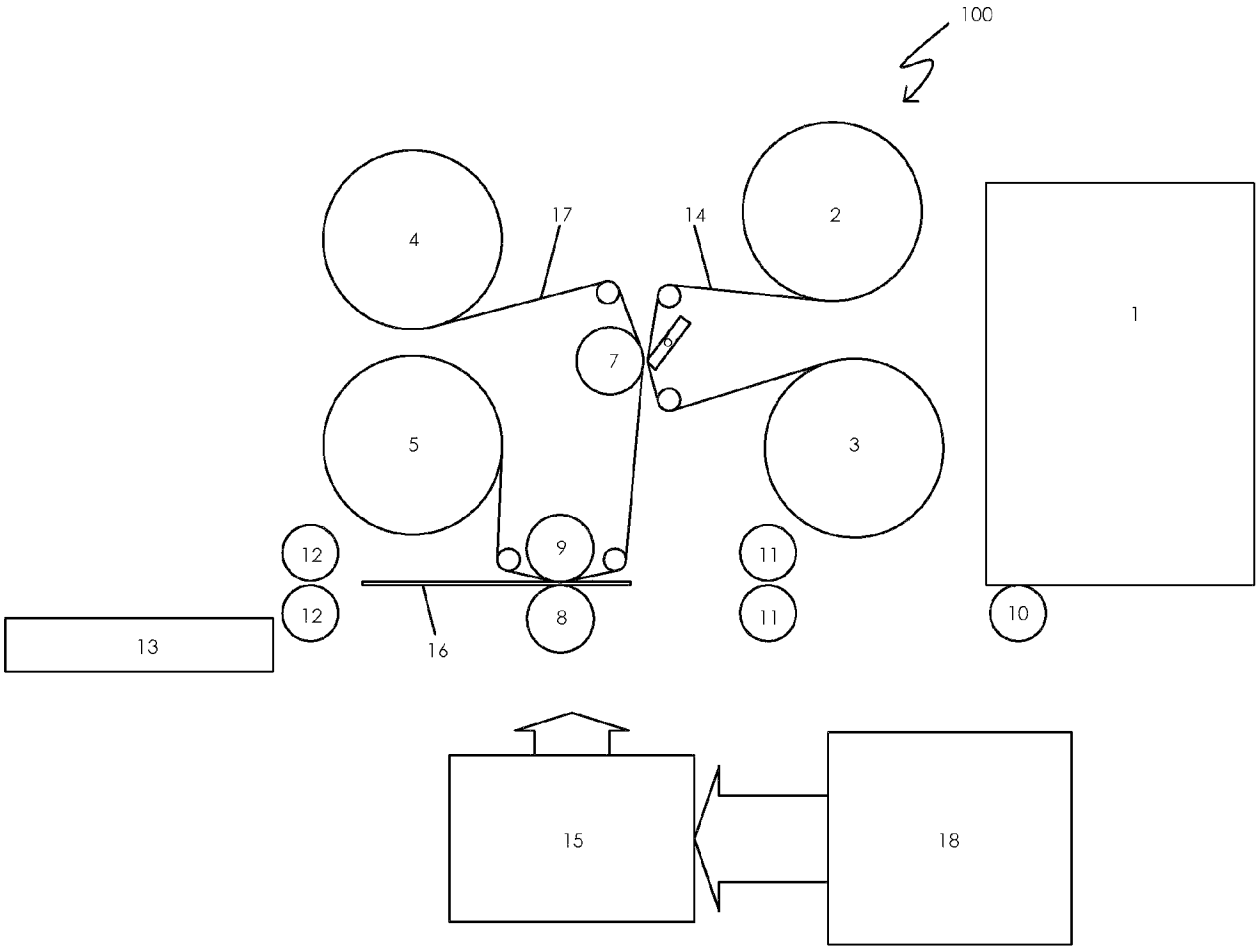
FIG. 1 is a diagrammatic illustration of a reverse transfer-type histological specimen slide color printer in accordance with one embodiment of the present invention.

FIG. 1 is an illustration of a histological slide printer 100 in accordance with one embodiment of the present invention. Operation of the printer 100 is controlled by controller 15 coupled to the electrical components of the printer. Histology slides such as 16 to be printed by the printer 100 can be loaded in an input area 1. Slides 16 are removed from the input area 1 by in-feed roller 10 and driven by transfer rollers 11 to a lamination area including lamination platen 8 and hot laminator roller 9. As described below, monochromatic or color specimen information is printed onto a retransfer ribbon 17 by printhead 6. At the lamination area the portion of the retransfer ribbon 17 with the printed specimen information is laminated onto (i.e., applied to) a print zone of the slide 16. The printed slide 16 is then driven to the output area 13 by output transfer rollers 12.

Embodiments of printer 100 configured to print in color can use a multi-color thermal transfer print ribbon 14 that can be provided on supply 2, and a thermal retransfer ribbon 17 that can be provided on supply 4. Following their use the print ribbon 14 is collected on take-up 3 and the retransfer ribbon is collected on take-up 5. Print ribbon 14 includes a substrate carrying a heat transferrable ink layer. In these embodiments the ink layer can include blocks of ink of different (typically primary) colors (e.g., yellow, magenta, cyan and black in one embodiment) spaced in a repeating sequence along its length. In other embodiments, such as those configured to print in monochrome, the ink layer can include a single color ink (e.g., black ink) and need not be in blocks. The ink can, for example, include sublimable dyes or heat-transferrable resins. Retransfer ribbon 17 includes a substrate carrying a transparent transfer film. As described below, in response to lamination processes such as those involving heat and/or pressure, portions of the transfer film can be removed from the substrate of the retransfer ribbon 17 and applied to the slide 16.

Controller 15 is coupled to receive print jobs from a device such as computer 18. The print jobs include data relating to the desired specimen information to be printed. Controller 15 processes the data and controls the printer 100, including printhead 6, in a manner that causes the specimen information to be printed in the desired form and color onto the retransfer ribbon 17.

With the printhead 6 at a spaced-apart position (e.g., raised by a printhead raising and lowering mechanism) with respect to the print platen roller 7, controller 15 advances the retransfer ribbon 17 to a printing area between the printhead and print platen roller. Registration marks can be located on the retransfer ribbon 17 to designate the print areas or regions on the retransfer ribbon. Controller 15 also advances the print ribbon 14 to position and register a first ink block of the desired color at the printing area. The printhead 6 and print platen roller 7 are then brought together (e.g., the printhead is lowered) to position the ink layer of the print ribbon 14 next to and typically in contact with the transfer film layer of the retransfer ribbon 17. The co-located portions of the print ribbon 14 and retransfer ribbon 17 are then driven together (i.e., simultaneously) in a first or print direction past the printhead 6. During this printing operation the printhead 6 is actuated to print the specimen information onto the retransfer ribbon by transferring ink from the first color block of the print ribbon 14 onto the transfer film layer of the retransfer ribbon 17. After printing the first color portion of the specimen information onto the print area of the retransfer ribbon 17 the printhead 6 is raised or otherwise moved to a spaced-apart position with respect to the print platen roller 7.

If the specimen information to be printed requires multiple ink colors, the retransfer ribbon 17 is driven in a second and opposite direction to reposition the leading edge of the retransfer ribbon print area adjacent to the printhead 6, and the print ribbon 14 is driven (typically in the first direction) to advance and register a second color ink block at the print area of the retransfer ribbon. The printhead 6 is then lowered, and the printing operation described above is repeated for the second color ink on the print area. This process is repeated again for any additional colors of ink as needed and appropriate to complete the printed image of the specimen information on the print area of the retransfer ribbon 17. As described below, the specimen information image is printed in reverse or mirror image form onto the retransfer ribbon 17 because it will be displayed through the transfer film after being laminated onto the slides 16.

With the laminator roller 9 raised or otherwise spaced-apart from the lamination platen 8, the retransfer ribbon 17 is driven to advance the print area to the lamination area and to register the print area with the print zone on the slide 16. The laminator roller 9 is then lowered or the laminator roller and lamination platen 8 otherwise moved together to place the print area of the retransfer ribbon 17 into contact with the slide 16. The slide 16 and retransfer ribbon 17 are driven together (i.e., simultaneously) through the lamination area and between the hot laminator roller 9 and lamination platen 8. Heat and/or pressure applied by this lamination process causes the portion of the transfer film layer of the retransfer ribbon 17 containing the printed specimen information image to transfer onto and to adhere to the print zone of the slide 16. The ink layer on the transfer film will be facing the slide 16, and covered by the transfer film layer. The transfer film can act as a protective barrier for the printed specimen information image. The printed image is visible through the transparent transfer film layer. In embodiments of the invention, the lamination roller 9 can be relatively soft and compliant (e.g., rubber-like). The roller thereby deforms to generally conform to the surface contour and texture of the slide 16 or other specimen container. During this process the transfer film is thereby also deformed, and will conform to the overall surface shape as well as to relatively small variations in surface roughness to enhance the attachment of the printed film layer to the slide 16 or other specimen container. The surface of the specimen container being printed need not, therefore, be flat. Another advantage of printer 100 is that it enables printing all the way to the edges of the slide or other container.

Figure 2:
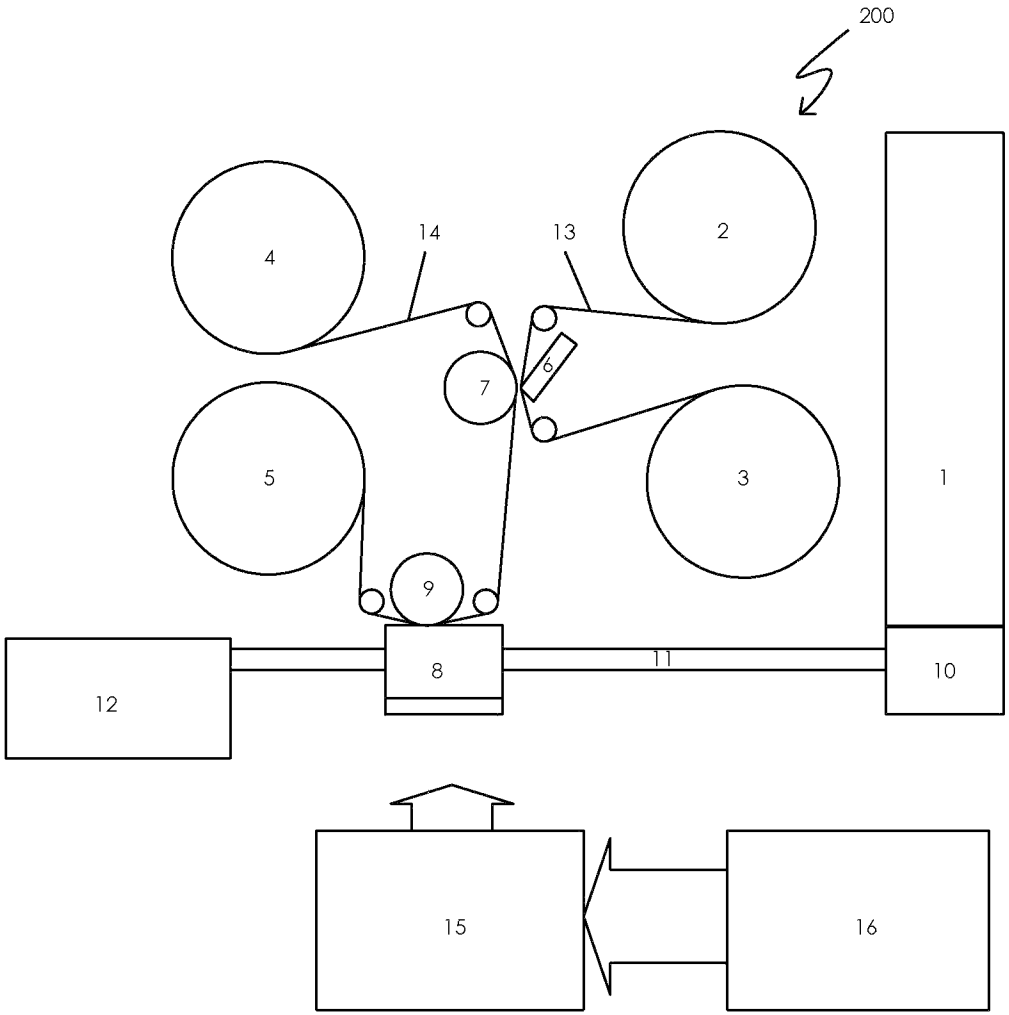
FIG. 2 is a diagrammatic illustration of a reverse transfer-type histological specimen cassette color printer in accordance with another embodiment of the present invention.

FIG. 2 is an illustration of a histological cassette printer 200 in accordance with another embodiment of the present invention. Printer 200 prints specimen information onto the print zones of specimen cassettes such as those described above. As shown in FIG. 2, the cassettes can be loaded into the printer 200 at an input area 1. A media shuttle 8 transfers the cassettes between the input area 1, the lamination area including the hot laminator roller 9, and the output area 12. In-feed mechanism 10 transfers cassettes from the input area 1 to the media shuttle 8. A transport mechanism 11 drives the media shuttle 8 between the in-feed mechanism 10 and the output area 12. Input area 1, media shuttle 8, in-feed mechanism 10, transport mechanism 11 and output area 12 can, for example, be structures similar to or substantially the same as those in the above-identified PCT publications that provide corresponding functions.

Other than the differences described herein, the components of cassette printer 200 and the operation of these components can be similar to or substantially the same as those in the slide printer 100 described above. Cassette printer 200 includes a printing area that includes the printhead 6 and print platen roller 7. Multiple colors or a single color of ink are provided on a print ribbon 13. At the printing area the printer 200 prints color or monochromatic images of specimen information onto print areas of the transfer film layer of the retransfer ribbon 14. The print areas of the retransfer ribbon 14 are advanced to the lamination area at which they are laminated or otherwise transferred onto the print zones of cassettes being transported by the media shuttle 8. Printer 200 provide advantages of the type described above in connection with printer 100.

Although the invention has been described with reference to preferred embodiments, those skilled in the art will recognize that changes can be made in form and detail without departing from the spirit and scope of the invention.

The invention claimed is:

1. A color printer for printing specimen information onto histological specimen containers having a print zone, including:

a specimen receiving structure configured to receive and hold histological specimen slides or cassettes having print zones;

an ink receiving structure to receive a multi-colored ink source;

a multi-colored thermal transfer print ribbon on the ink receiving structure;

a transfer receiving structure to receive a retransfer ribbon;

a retransfer ribbon on the transfer receiving structure, the retransfer ribbon having a transfer film layer;

a printing area including a thermal printhead;

a lamination area including a compliant laminator roller, wherein the laminator roller urges the retransfer ribbon onto the print zones of the slides or cassettes and deforms to conform to surface contours of the print zones and thereby cause the transfer film layer to deform and conform to surface contours of the print zones; and an in-feed and transport to remove slides or cassettes from the specimen container receiving structure and move the slides or cassettes to the lamination area;

a port to receive print job data, wherein the print job data includes data relating to specimen information to be printed and colors of the information to be printed; and a control system coupled to the port to receive the print job data, to cause the printhead to print the specimen information in color by heating and transfering multiple colors of ink from the print ribbon to print areas on the transfer layer of the retransfer ribbon based on the print job data, and to cause the laminator roller to transfer the printed print areas of the transfer layer to the print zones of the slides or cassettes, with the transfer layer covering the ink on the slides or cassettes.

2. The specimen container printer of claim 1 wherein:

the print job data includes color data representative of a color that identifies specimen information; and the control system causes the printhead to print the specimen information in color as a function of the color data.

3. The specimen container printer of claim 2 and further including a color selecting system to select the color data as a function of the print job data that identifies the specimen information.

4. The specimen container printer of claim 3 wherein the color selecting system selects the color data as a function of print job data identifying tissue type.

5. The specimen container printer of claim 2 wherein the control system causes the printhead to print the specimen information in the form of color blocks.

6. The specimen container printer of claim 1 wherein the control system causes the printhead to transfer at least two colors of ink from the print ribbon and print the specimen information in at least two colors on at least some of the slides or cassettes.

7. A method for color printing information onto histological specimen containers, including:

printing an ink specimen information image onto a transfer layer of a retransfer ribbon, including causing a thermal printhead to print specimen information in color by heating and transferring multiple colors of ink from a multicolored thermal transfer print ribbon to print areas on the transfer layer of the retransfer ribbon; and transferring the transfer layer with the specimen information image onto a print zone of a histological specimen slide or cassette having surface contours, with the transfer layer covering the ink on the slides or cassettes, including engaging the retransfer ribbon with a compliant laminator roller to urge the retransfer ribbon onto the print zones and to deform the laminator roller to conform to surface contours of the print zones and thereby cause the transfer layer to deform and conform to the surface contours of the print zones.

* * * * *

UNITED STATES PATENT AND TRADEMARK OFFICE

CERTIFICATE OF CORRECTION

PATENT NO. : 9,007,411 B2
APPLICATION NO. : 14/030371
DATED : April 14, 2015
INVENTOR(S) : Robert P. Cummins et al.

It is certified that error appears in the above-identified patent and that said Letters Patent is hereby corrected as shown below:

In the claims,

In Column 4, line 31, after "a specimen" please insert --container--.

Signed and Sealed this
Ninth Day of February, 2016

Michelle K. Lee

Michelle K. Lee
*Director of the United States Patent and Trademark Office*